United States Patent [19]

Frost

[11] Patent Number: 4,763,615

[45] Date of Patent: Aug. 16, 1988

[54] DESMODROMIC VALVE SYSTEM

[75] Inventor: Derek Frost, Leigh-On-Sea, United Kingdom

[73] Assignee: Ford Motor Company, Dearborn, Mich.

[21] Appl. No.: 937,754

[22] Filed: Dec. 4, 1986

[30] Foreign Application Priority Data

Dec. 7, 1985 [GB] United Kingdom ..... 8530218

[51] Int. Cl.[4] ..... F01L 1/30

[52] U.S. Cl. ..... 123/90.25; 123/90.49; 123/90.47

[58] Field of Search ..... 123/90.6, 90.24, 90.25, 123/90.26, 90.44, 90.47, 90.52, 90.53, 90.40, 90.19, 90.45, 90.48, 90.49

[56] References Cited

U.S. PATENT DOCUMENTS

| | | | |
|---|---|---|---|
| 2,817,326 | 12/1957 | Taylor | 123/90.52 |
| 2,831,470 | 4/1958 | Lorscheidt | 123/90.24 |
| 2,954,016 | 9/1960 | Leese | 123/90.52 |
| 3,430,614 | 3/1969 | Meacham | 123/90.24 |

FOREIGN PATENT DOCUMENTS

| | | | |
|---|---|---|---|
| 0578429 | 6/1933 | Fed. Rep. of Germany | 123/90.24 |
| 0590149 | 6/1925 | France | 123/90.25 |
| 0815195 | 7/1937 | France | 123/90.26 |
| 0476366 | 11/1975 | U.S.S.R. | 123/90.24 |

*Primary Examiner*—Willis R. Wolfe, Jr.
*Assistant Examiner*—M. Macy
*Attorney, Agent, or Firm*—Robert E. McCollum; Clifford L. Sadler

[57] ABSTRACT

The invention relates to a desmodromic system in which a valve stem is arranged to be acted upon directly, or by way of rockers, by an opening cam and a closing cam rotatable together at constant or varying angular velocity in synchronism with the rotation of the engine crankshaft, and in which a compliance device is incorporated in the transmission train from the cams to the valve stem, the compliance device comprising two cup-shaped members nested together with a limited relative movement between and resiliently urged away from one another, the compliance device operating to provide zero clearance when the valve is open and maximum clearance when closed to accommodate valve recession and thermal expansion.

2 Claims, 1 Drawing Sheet

DESMODROMIC VALVE SYSTEM

Figure 1:
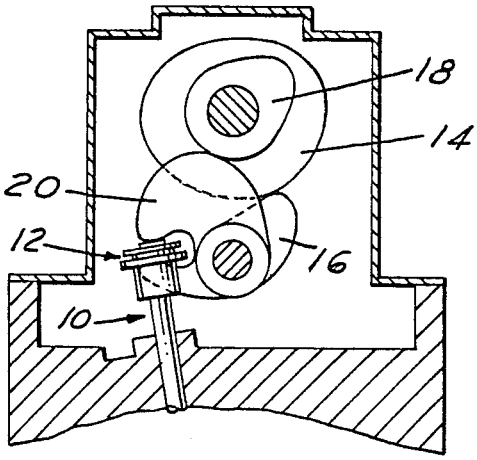

The present invention relates to desmodromic valve operation in an internal combustion engine.

In a conventional internal combustion engine, the valves of the cylinders are closed by means of springs. A relatively strong spring is required and this in turn can place considerable stresses on the cam surfaces.

It has therefore previously been proposed to employ a so-called desmodromic valve train in which the valves are both opened and closed by the action of a cam and only a relatively light spring is required to maintain the valve in the closed position.

Desmodromic valve systems are superior to conventional systems in both breathing (time area of the event) and friction. However, such valve systems do suffer from certain problems which have hitherto prevented them from being adopted.

The most serious objections to the adoption of desmodromic valve systems are expense and noise. The previously proposed systems have been expensive to manufacture and to maintain and have suffered from relatively noisy operation.

Modern manufacturing technology and good design have reduced the manufacturing cost but the running cost (cost of ownership) and noise remain as serious problems. The cause of these problems will now be considered.

During use, valves wear into their valve seats, this being referred to as valve recession. With desmodromic valve operation, recession is expected to be reduced but it remains nevertheless necessary to reset the operating clearances at some regular service interval to allow for valve recession. Such a need for frequent servicing is unacceptable to large fleets, as the vehicles need to be off the road, and is unacceptable to the general public on account of the cost.

As for the noise problem, one of the main causes for this problem arises from the need to allow for thermal expansion. Allowance for thermal expansion requires a clearance which enables the valve to rattle between its operating cams or levers, as the case may be.

Because of the fact that in a desmodromic system, both the opening and the closing of the valves is achieved mechanically, the clearance needed for the valve stem expansion will remain as a clearance throughout the entire valve cycle.

In a system in which valve return is achieved by means of a return spring, the operating clearance provided in the valve train only needs to accommodate stem expansion when the valve is closed. This is because during the period that the valve is open, which period is referred to as the event, the cam is held in contact with the follower by the valve spring so that no clearance problems can occur.

On the other hand, in a desmodromic valve system, allowance for thermal expansion must be made both in the open and in the closed position of the valve, as they are both controlled mechanically.

The present invention seeks to mitigate the foregoing problems previously encountered in all desmodromic valve systems.

According to the present invention, there is provided a desmodromic system in which a valve stem is arranged to be acted upon directly, or by way of rockers, by an opening cam and a closing cam rotatable together at constant or varying angular velocity in synchronism with the rotation of the engine crankshaft, and in which a compliance device is incorporated in the transmission train from the cams to the valve stem, the compliance device comprising two members resiliently urged away from one another and coupled to one another in such a manner that they can only move apart by a predetermined distance, and in which the opening and closing cams are shaped such that during the valve opening event the valve stem is captured between the opening and closing rockers without clearance and with the compliance device fully compressed and the cams are shaped to allow clearance to accommodate valve recession and thermal expansion when the valve is closed.

As earlier stated, with desmodromic operation, the valve clearance necessary to allow for valve recession remains throughout the valve opening event. However, the result of the presence of such a clearance is that the valve is allowed to float noisily during the operating cycle. The change over from one cam to the other is especially noisy as it is at this time that the valve stem traverses the clearance and collides at its highest speed with the other of the two cams.

To mitigate this problem, in the present invention, the opening and closing cams are shaped such that during the valve opening event the valve stem is captured between the opening and closing cams without clearance and with the compliance device fully compressed. The cams are however shaped to allow clearance to accommodate valve recession and themal expansion when the valve is closed but at this time in the cycle the compliance device ceases to be compressed and expands under its own resilience to take up the clearance and urge the valve against the valve seat. The spring need not be strong but must be adequate, particularly on the exhaust valve since it must resist the induction pressures acting upon this valve.

The pressure in the cylinder will be acting to maintain the valves closed throughout the rest of the cycle.

Preferably, the compliance device is fitted directly to the valve stem and is arranged between opening and closing rockers transmitting the force of the opening and the closing cam respectively.

The compliance device conveniently comprises a first cup fitted movably to the valve stem, a spring received within the first cup and a second cup received within the first cup and rigidly secured to the valve stem.

It is alternatively possible for the compliance device to be wholly or partly incorporated in one of the opening and closing rockers.

As stated previously, desmodromic valve systems in which the valves are both opened and closed by the action of a cam are known. See, for example, Br. No. 108,087, Br. No. 281,082, Br. No. 579,914 and U.S. Pat. No. 4,471,729. Each of these systems, however, requires a strong spring for seating purposes and must provide a gap to accommodate thermal expansion, general wear and valve recession. There is no provision for closing this gap during the event, as there is in this invention to be described, and the valve inertia will cause the valve to float across the gap and produce unacceptable noise. This invention closes the gap during the event.

Figure 2:
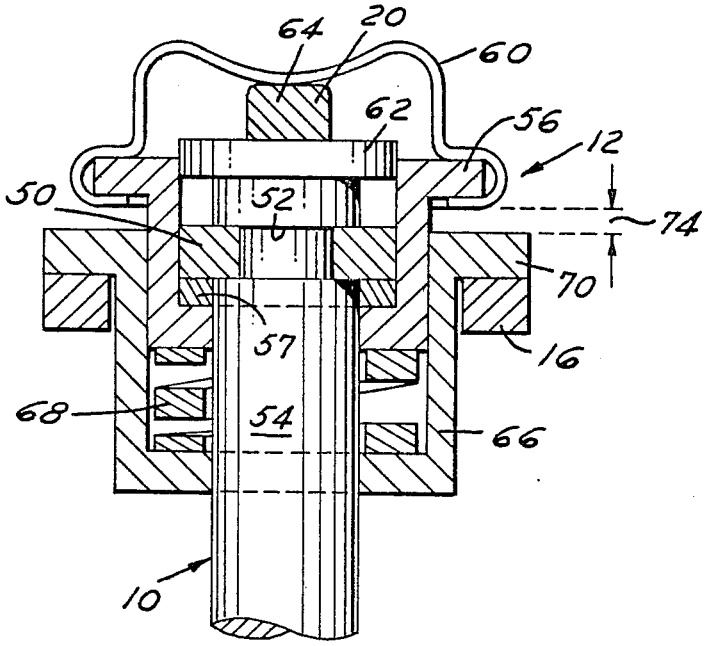

The invention will now be described further, by way of example, with reference to the accompanying drawings, in which:

FIG. 1 is a schematic representation of a valve stem acted upon by two cams by way of respective rockers; and FIG. 2 shows the compliance device of FIG. 1 in greater detail.

FIG. 1 shows a valve stem 10, the upper end of which is fitted with a compliance device 12 to be described in greater detail below. The valve 10 is acted upon by a closing cam 14 by way of a closing rocker 16, which preferably includes a cam follower roller, and by an opening cam 18 by way of an opening rocker 20. It is not essential that there be an opening rocker as the opening cam can be arranged to act directly upon the valve stem.

In operation, as the cams rotate, the ramp of the opening cam 18 moves rocker 20 to urge the valve 10 downwardly off its seat and into the cylinder to open the valve. The return movement is carried out by the closing cam 14 acting through rocker 16 to lift the valve upwardly back towards its seat, to be finally closed by its own inertia acting on a ramp on the cam of the opening lever. In the latter respect, the desmodromic valve system differs from a conventional system in which the valve is returned to its seat by a strong valve spring. Because there is no spring force to be overcome, the system is more efficient. Furthermore, the cams can be profiled to maximize the rate of opening and closing of the valve without risk of damage through excessive force on the camshaft and cam surfaces. Extended ramps will be necessary to ensure that seating and unseating deceleration/acceleration rates remain constant as the valve recesses closer to its cam.

The problem with conventional desmodromic systems is that it is not possible to permit zero clearance at all times since the valve length changes both with temperature and with wear; and, without clearance the valve would not seat correctly at all times. On the other hand, in the presence of a clearance, noise is caused by the stem rattling between the two cams. Furthermore, clearance must be set with accuracy requiring frequent maintenance that adds to the cost of ownership.

The compliance device 12 now to be described obviates these disadvantages. Referring to FIG. 2, the valve 10 is fitted with cotters 50 or a circlip and held in place in a groove 52 in the valve stem 54 by means of a cup 56. The cup 56, which holds a shim 57, is held on the valve stem 54 by means of a light spring 60. The latter passes over a shim 62 and would pass over either a cam follower 64 directly acted upon by the opening cam, or the opening rocker 20 shown in the arrangement of FIG. 1.

The first cup 56 is received within a second cup 66 which holds a coil spring 68. The second cup 66 has a flange 70 engaged from below by the closing rocker 16 of FIG. 1.

As illustrated in FIG. 2, the two cups have a predetermined gap 74 between them provided by spring 68, the gap offering clearance to allow for thermal expansion and valve recession. This gap is matched to extended ramps on the cams.

The cups can be brought together to close the gap 74 while at the same time compressing the spring 68. The spring 68 only acts to urge the valve against its valve seat when the valve is closed and at all other times it is compressed and the cups 56 and 77 directly abut one another.

The cams are shaped and dimensioned such that at all times that the valve is open and off its seat the cups of the compliance device are in direct contact and there is negligible clearance. The clearance can be set by suitable dimensioning of the shims. When the valve is closed, the distance between the cam followers or rockers can widen to allow for expansion and recession. At this time the compliance device expands and the stem is raised by the internal spring 68 to close the valve. The shape of the cams must be such as to allow sufficient clearance when the valve is closed to allow for the worst case of recession and expansion.

Because of the clearance free support of the valve stem at all times that the valve is open, the problem of noise is effectively reduced while the need for frequent servicing is obviated by the compliance device taking up any wear due to recession.

While the invention has been shown and described in its preferred embodiment, it will be clear to those skilled in the arts to which it pertains that many changes and modifications may be made thereto without departing from the scope of the invention.

I claim:

1. A desmodromic system for the stem of a reciprocable valve arranged to be opened and closed by a pair of opening and closing cams each engaging a rocker arm for alternately actuating the valve stem, including a compliance device between the rocker arms and the valve stem, the compliance device comprising two members, means connecting the members for a limited axial movement of at least one of the members relative to the other, resilient means providing a clearance at times between the members by urging the members apart from one another, the opening and closing cams being shaped such that during the valve opening event the valve stem is captured between the members without clearance therebetween by the opening cam and rocker arm fully compressing the compliance device to provide positive unitary movement of the two members, the rocker arms being shaped to provide said clearance to accommodate valve recession and thermal expansion when the valve is closed by expansion of the resilient means.

2. A system as claimed in claim 1, wherein the compliance device comprises first and second nested cups fitted movably to the valve stem, and a spring received between the cups, one of the cups being rigidly secured to the valve stem.

* * * * *